United States Patent [19]

Adler

[11] Patent Number: 4,794,868

[45] Date of Patent: Jan. 3, 1989

[54] CONCEALABLE ENCLOSURE TABLE

[75] Inventor: Josef H. Adler, Martinez, Calif.

[73] Assignee: Nesher Industries, Inc., Martinez, Calif.

[21] Appl. No.: 91,706

[22] Filed: Sep. 1, 1987

[51] Int. Cl.[4] ..... A47B 51/00

[52] U.S. Cl. ..... 108/33; 312/272; 108/146

[58] Field of Search ..... 108/38, 136, 146; 312/270, 22, 284, 285, 272, 272.5

[56] References Cited

U.S. PATENT DOCUMENTS

| | | | |
|---|---|---|---|
| 48,888 | 7/1865 | Atwater | 108/146 X |
| 182,643 | 9/1876 | Dallenne et al. | 312/272.5 |
| 1,063,766 | 6/1913 | Becker | 108/146 X |
| 1,888,478 | 11/1932 | Steidl | 108/146 X |
| 2,122,042 | 6/1938 | Mattucci | 312/272 X |
| 3,416,849 | 12/1968 | Dube | 312/272 X |
| 3,444,830 | 5/1969 | Doetsch | 108/136 |
| 3,985,410 | 10/1976 | Young et al. | 312/270 X |

FOREIGN PATENT DOCUMENTS

| | | | |
|---|---|---|---|
| 839847 | 5/1952 | Fed. Rep. of Germany | 108/146 |
| 576634 | 5/1958 | Italy | 312/272 |
| 372939 | 5/1932 | United Kingdom | 312/272 |

*Primary Examiner*—Peter A. Aschenbrenner
*Attorney, Agent, or Firm*—Limbach, Limbach & Sutton

[57] ABSTRACT

The present invention includes a concealable enclosure table which has a rotatable moveable enclosure having an open position and a closed position. The table also has a flange coupled to the enclosure. The flange has a notch. A slideably mounted latch pin with a beveled face engages the flange to hold the enclosure in the closed position. The latch pin also passes through the notch to release the flange to allow the enclosure to move from the closed position to the open position. The pin has a projected position and a retracted position.

11 Claims, 2 Drawing Sheets

CONCEALABLE ENCLOSURE TABLE

FIELD OF THE INVENTION

This invention relates to the field of furniture. More particularly, this invention relates to a table having a concealable enclosure which, upon activation, is opened by rising out of an upper surface of the table.

BACKGROUND OF THE INVENTION

Furniture is known with concealed enclosures which rise out of the top of the furniture. A common use for such furniture is as a bar or liquor cabinet which can easily be removed from sight when not in use. Such known furniture has a switch, lever or foot pedal to activate the release mechanism or to re-catch the latch into the closed position. The use of switches, latches or foot pedals is cumbersome in that the person attempting to open or close the bar must ensure that precise contact is made with the switch, latch or foot pedal.

Techniques used to raise and lower the concealed enclosure include counterbalanced weights, electric motors and pneumatic springs. The counterbalanced weights require a volume of space for the weights to travel through in order to operate. Thus, the concealed enclosure must be somewhat smaller than the size of the piece of furniture in which it is enclosed. The use of an electric motor prevents the use of the furniture in every location since it requires placement of the device in a location where electric power is accessible.

SUMMARY OF THE INVENTION

The present invention includes a concealable enclosure table which has a rotatable moveable enclosure having an open position and a closed position. The table also has a flange coupled to the enclosure. The flange has a notch. A slideably mounted latch pin with a beveled face engages the flange to hold the enclosure in the closed position. The latch pin also passes through the notch to release the flange to allow the enclosure to move from the closed position to the open position. The pin has a projected position and a retracted position.

DETAILED DESCRIPTION OF THE PREFERRED EMBODIMENT

Figure 1:
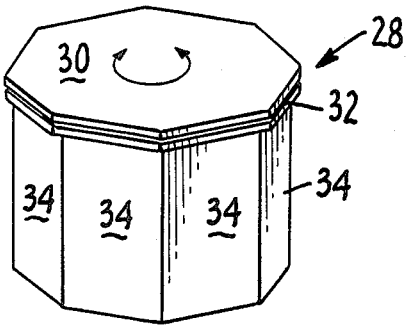
FIG. 1 is a perspective view of the preferred embodiment of the, present invention in a closed configuration.

The present invention includes a concealable enclosure. The enclosure is positioned to retract into the top surface of a piece of furniture such as a table. FIG. 1 shows an octagonal table of the present invention. The table of FIG. 1 has a top 30, a rim 32 and, because of the octagonal shape, eight identical sides 34, only four of which are shown here. The shape of the table is not critical to the present invention. The table may be a square, triangle, pentagon or even a circle.

Figure 2:
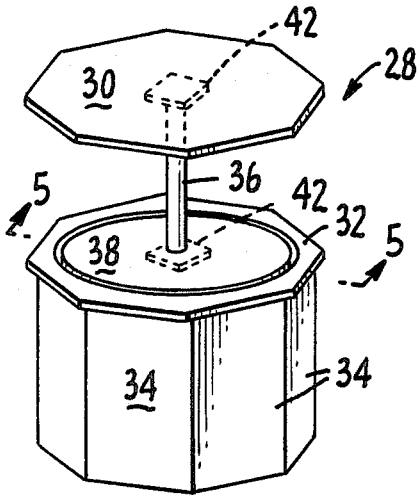
FIG. 2 is a perspective view of the preferred embodiment of the present invention in an opened position.

The table 28 is shown in the closed position in FIG. 1 and thus, the concealable enclosure is not visible. In FIG. 2, the table 28 is shown in the open position such that the enclosure is visible. The table top 30 is shown to be supported by a central support tube 36. The support tube 36 is attached to the underside of the table top 30 and to the top of a support platform 38. In the preferred embodiment the support tube 36 is surrounded by a decorative finished tube 37.

The top 30 and platform 38 are preferably attached to the support tube 36 by screws through a pair of plates 42. The plates 42 are welded to the support tube 36. A first plate 42 is positioned beneath the top 30 at the upper end of the support tube 36. A second plate 42 is positioned beneath the platform 38 near but spaced apart from the lower end of the support tube 36.

The enclosure 40 is positioned between the underneath side of the top 30, the top of the platform 38 and within boundaries established by projection of the edges of the platform 38 vertically up from the plane of the top surface of the platform 38 to the plane of the bottom surface of the top 30. When the moveable assembly consisting of the table top 30, the support tube 36, the plates 42 and the platform 38 are lowered within the confines of the table walls 34, the enclosure 40 disappears as does any object stored in the enclosure 40.

Figure 3:
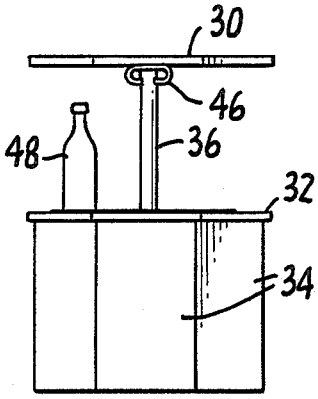
FIG. 3 is a front view of the preferred embodiment of the, present invention in an opened position.
Figure 4:
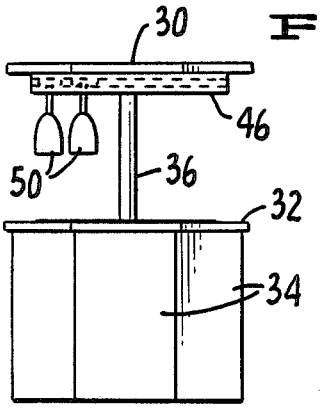
FIG. 4 is a side view of the preferred embodiment of the present invention in an opened position.

FIG. 3 and FIG. 4 are front and side views, respectively, of the table in the open position. An ideal application for the concealable enclosure table is a bar to store liquor bottles 48, glasses 50 and bartending paraphanalia. The clutter associated with a bar is made to vanish by simply closing the concealable enclosure table. In FIGS. 3 and 4, rack 46 is attached to the underside of the top 30 for convenient storage of stemwear glasses 50 as shown in FIG. 4.

Figure 5:
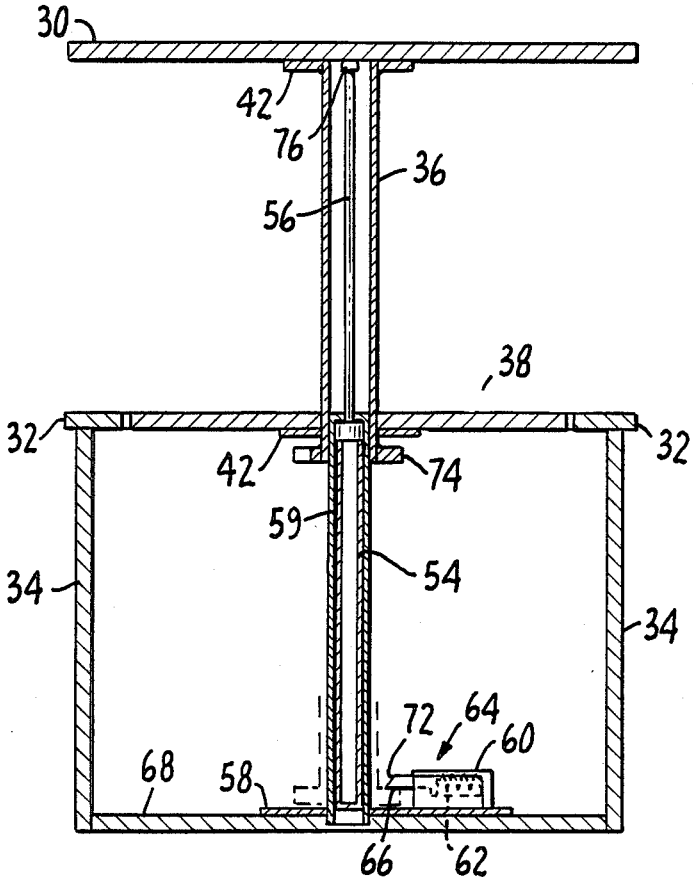
FIG. 5 is a cross section taken along the lines 5—5 in FIG. 2, of the preferred embodiment of the present invention in an opened position.

FIG. 5 shows a cross section of the preferred embodiment of the present invention in the open position. Table top 30 is attached to plate 42. Plate 42 is connected to support tube 36. Support tube 36 is attached to another plate 42. The second plate 42 is attached to the underside of the platform 38. The support tube 36 is shown to extend through platform 38. A flange 74 is shown at the lower end of support tube 36. The platform 38 extends between opposite internal edges of the rim 32 which encircles the platform 38. The rim 32 is supported by the walls 34 of the table 28. Finish tube 37 surrounds the support tube 36.

The pneumatic spring assembly includes pneumatic spring housing 54, rod 56, and support end 76. The support end 76 is connected to the upper distal end of the rod 56. Rod 56 is positioned to slideably enter housing 54. The pneumatic spring assembly is slideably inserted into base tube 59. The base tube 59 is of a sufficiently small size as to pass easily within support tube 36. The base tube 59 is mounted onto the base plate 58 by welding. The base plate 58 is mounted onto the base 68. The extreme lower end of the base tube 59 may penetrate through a hole in the base plate 58 and into the base 68. The moveable assembly is supported on support end 76.

The spring-loaded latch assembly 64 is preferably mounted on the base plate 58 by welding. The latch assembly 64 may also be mounted directly onto the base 68. The latch pin 66 is spring loaded by the latch spring 62 into the latch housing formed of latch housing base 60 and latch housing cap 61. The pin 66 is fitted into a slot 63 in the latch housing base 60. The spring 62 is positioned in the slot 63 behind the pin 66. Press pin 65 is fitted into the pin 66 through slide hole 67 to allow the pin 66 to move between an extended position and a retracted position. The spring 62 predisposes the pin 66 into the extended position.

The pin 66 has a beveled face 72 facing up to receive the flange 74. Upon lowering the moveable assembly the flange 74 will contact the face 72 of the pin 66 causing the pin 66 to compress the latch spring 62 and thereby retract the pin 66 into the latch housing. After the flange is lowered past the pin 66 the pin 66 is released and extends via the spring 62 to hold the flange 74 in place.

Figure 6:
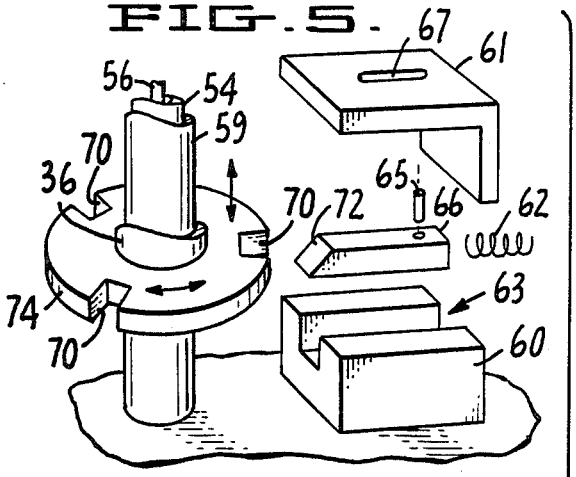
FIG. 6 shows the latching and release mechanism of the preferred, embodiment of the present invention.

FIG. 6 shows a perspective view of the flange 74 and support tube 36 and the latch assembly 64. The flange 74 is a circular member. Support tube 36 is connected to the flange 74 preferably by welding. One or more notches 70 are cut into the outer edge of the flange 74 at least large enough to allow the fully extended latch pin 66 to pass therethrough.

Figure 7:
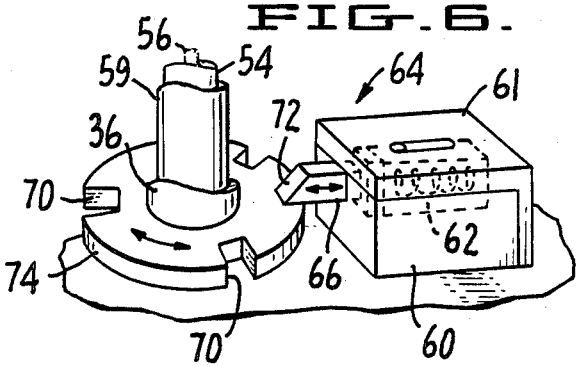
FIG. 7 shows an enlarged, perspective view of the latching and release mechanism in a latched position.
Figure 8:
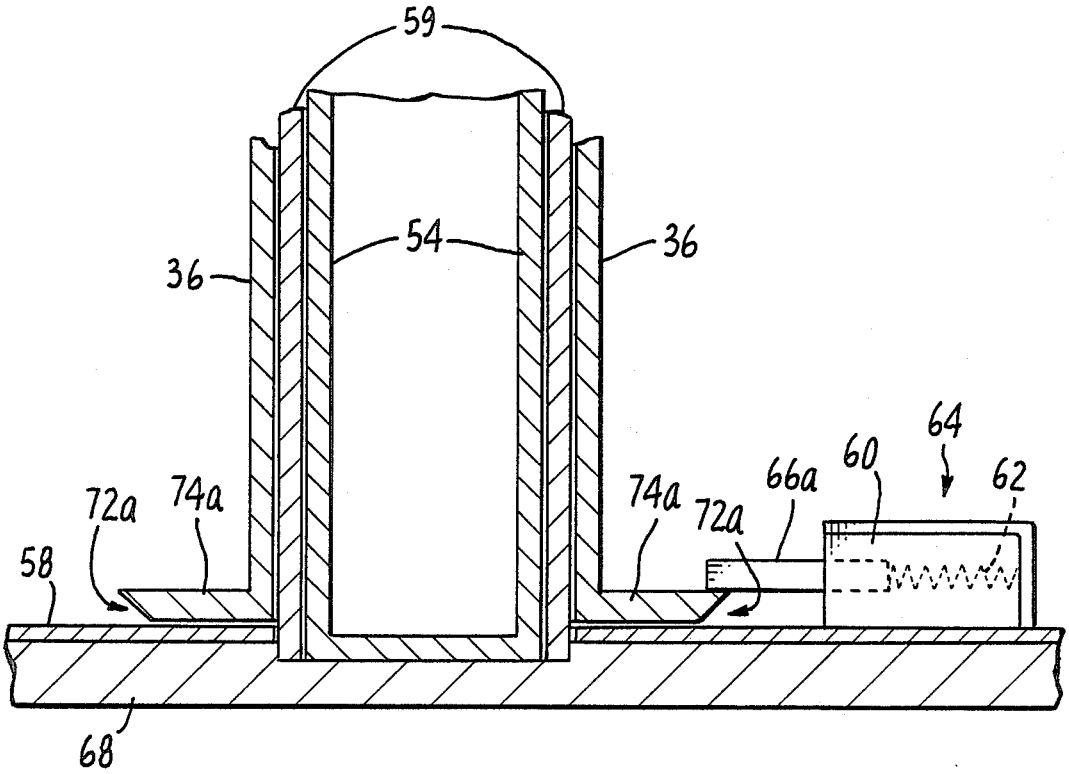
FIG. 8 shows a cross section of an alternate embodiment of the present invention.

FIG. 7 shows the flange 74 and latch 66 in the latched and closed position. By applying sufficient force to the top of table 28, the top 30 is lowered causing the rod 56 to retract into the pneumatic spring housing 54. By forcefully lowering the table top 30 the flange 74 is brought into contract with the latch pin 66. As described above, upon lowering the moveable assembly the flange 74 will contact the face 72 of the pin 66 causing the pin to compress the latch spring 62 and thereby retract into the latch housing 60. As the moveable assembly is further lowered the flange 74 passes beyond the latch pin 66 whereby the latch spring 62 will project the latch pin 66 to hold the moveable assembly down continuing to compress the raising spring 58. FIG. 8 shows a cross section of an alternate embodiment of the present invention. In this alternate embodiment the edge of the flange **74*a* has a beveled surface 72*a* and the end of the latch pin 66*a*** is straight.

The moveable assembly is designed to rotate easily. By rotating the table top, the flange 74 is also rotated bringing a notch 70 into juxtaposition with latch 66 releasing flange 74 from the latched and closed position. The pneumatic spring assembly then raises the assembly of table top 30, support tube 36, platform 38, plates 42 and flange 74 into the open position.

Occasionally the latch pin 66 passes through a notch 70 while attempting to close the concealable enclosure table. In the unlikely event that this happens it is necessary to rotate the table top 30 and thereby the moveable assembly and flange 74 to undo the alignment between the latch pin 66 and the notch 70 while holding the top 30 in the closed position.

A concealable enclosure table has been disclosed which is easy to close and to open. No manually controlled latching mechanisms, space consuming counterbalance weights or electrical power sources are required.

What is claimed is:

1. A concealable enclosure table comprising:

a. a base having a bottom, said base further having an upstanding support mounted on said bottom;

b. a rotatable tubular member having an upper end and a lower end, said tubular member slideably mounted over said upstanding support having an upper position and a lower position, said tubular member including a flange having at least one notch, said flange being mounted on the lower end of said tubular member;

c. a top mounted on the upper end of said tubular member;

d. a first spring means journaled about a rod and mounted within said tubular member for predisposing said tubular member and said top into an upper position; and e. a latch means mounted on said base having a retractable latch pin having an extended position and a retracted position, said latch pin for engaging said flange when said enclosure is in said closed position, said enclosure being released from said latch to said open position by aligning said notch in said flange with said latch pin.

2. The concealable enclosure table according to claim 1 further including a platform mounted on said tubular member above said flange and spaced apart from said top.

3. The concealable enclosure table according to claim 2 wherein first spring comprises a pneumatic spring assembly.

4. The concealable enclosure table according to claim 3 further comprising a base tube, said base tube for receiving said pneumatic spring assembly.

5. The concealable enclosure table according to claim 4 further comprising a base plate coupled to a lower end of said base tube, said base plate mounted on said bottom.

6. The concealable enclosure table according to claim 2 wherein said latch means includes a second spring means for predisposing said latch pin into said extended position.

7. The concealable enclosure table according to claim 6 further comprising a means for retracting said latch pin as said flange passes said latch pin.

8. The concealable enclosure table according to claim 7 wherein in said means for retracting comprises a bevel formed in an upper surface of said latch pin.

9. The concealable enclosure table according to claim 7 wherein said means for retracting comprises a bevel formed in a lower surface of said flange.

10. The concealable enclosure table according to claim 7 wehrein said latch means is mounted on said base plate.

11. A concealable enclosure table comprising:

a. an enclosure comprising:

(1) a hollow support tube having a first end, a second end, a first mounting plate coupled to said first end and a second mounting plate coupled to said second;

(2) a table top having a first upper surface and a first lower surface, said first lower surface coupled to said first mounting plate;

(3) a platform having a second upper surface, a second lower surface and a hole passing from said second upper surface to said second lower surface, said second upper surface coupled to said second mounting plate so that said hole is coincident with said hollow support tube; and (4) a hollow circular flange having a notch coupled to said second lower surface so that said hole is coincident with said hollow support tube;

b. a table structure comprising:

(1) a bottom having an indentation;

(2) an enclosing wall coupled to said bottom; and
(3) a rim coupled to an upper surface of said wall said table structure enclosing said enclosure in said closed position;

c. a base plate having a hole formed through the plate mounted on the bottom positioned to expose at least a portion of the indentation;

d. an upstanding base tube having an upper end and a lower end, the base tube passing through the hole in the base plate, entering the indentation, the base tube coupled to the base plate;

e. a pneumatic spring assembly inserted in the upper end of the base tube, said pneumatic spring assembly having a predisposed extended position and a first retracted position, said enclosure being in an open position when said pneumatic spring assembly is in said first extended position and in a closed position when said pneumatic spring assembly is in said first retracted position: and f. a latch assembly comprising:

(1) a slideably mounted latch pin having a beveled face for engaging said flange to hold said enclosure in said closed position or for passing through said notch to release said flange to allow said enclosure to move from said closed position to said open position, said pin having a projected position and a retracted position, said projected position for both holding said enclosure in said closed position and for passing through said notch and said retracted position for allowing said flange to pass said pin to allow said enclosure to move from said open position to said closed position;

(2) a latch spring coupled to said latch pin to maintain said latch pin predisposed to said projected position; and (3) a latch housing having a slot through which said latch pin passes, said latch housing mounted to said base plate.

* * * * *